US010184250B1

(12) United States Patent
Abdel-Rahman et al.

(10) Patent No.: US 10,184,250 B1
(45) Date of Patent: Jan. 22, 2019

(54) LOAD BEARING METAL STUD

(75) Inventors: Nabil Abdel-Rahman, Wake Forest, NC (US); Edward R. diGirolamo, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 0 days.

(21) Appl. No.: 12/233,123

(22) Filed: Sep. 18, 2008

Related U.S. Application Data

(63) Continuation-in-part of application No. 10/690,038, filed on Oct. 21, 2003, now abandoned.

(51) Int. Cl.
*E04C 3/04* (2006.01)

(52) U.S. Cl.
CPC ..... *E04C 3/04* (2013.01)

(58) Field of Classification Search
CPC ..... E04B 1/24; E04C 2/38; E04C 3/32; E04C 3/04; E04C 2003/0473; E04C 2003/0404; E04C 2003/0421; E04C 2003/0443; E04C 2/384
USPC ..... 52/733.2, 731.9, 690, 481.1, 841, 846
See application file for complete search history.

(56) References Cited

U.S. PATENT DOCUMENTS

| | | | | |
|---|---|---|---|---|
| 2,508,032 A | | 5/1950 | Kennedy | |
| 3,312,032 A | | 4/1967 | Ames | |
| 3,483,665 A | * | 12/1969 | Miller | 52/461 |
| 3,553,915 A | | 1/1971 | Passovoy | |
| 3,653,172 A | | 4/1972 | Schwartz | |
| 3,831,333 A | | 8/1974 | Nelsson et al. | |
| D257,639 S | | 12/1980 | Reid et al. | |
| 4,324,082 A | | 4/1982 | Rutkowski et al. | |
| 4,793,113 A | | 12/1988 | Bodnar | |
| 4,835,935 A | | 6/1989 | Murphy | |
| 4,886,899 A | | 12/1989 | Houser | |
| 5,157,883 A | * | 10/1992 | Meyer | 52/357 |
| 5,203,132 A | * | 4/1993 | Smolik | 52/241 |
| 5,485,706 A | | 1/1996 | Menchetti | |
| 5,515,658 A | | 5/1996 | Jorde | |
| 5,596,859 A | | 1/1997 | Horten et al. | |
| 5,724,784 A | | 3/1998 | Menchetti | |

(Continued)

FOREIGN PATENT DOCUMENTS

| | | |
|---|---|---|
| GB | 2 082 647 A | 3/1982 |
| GB | 2 147 025 A | 5/1985 |

OTHER PUBLICATIONS

Advisory Action corresponding to U.S. Appl. No. 10/690,038 dated Dec. 26, 2007.

(Continued)

*Primary Examiner* — William V Gilbert
(74) *Attorney, Agent, or Firm* — Jenkins, Wilson, Taylor & Hunt, P.A.

(57) ABSTRACT

An elongated load bearing metal stud including a web and a pair of flanges disposed on opposite sides of the stud. Formed in the central portion of the web is a channel. The channel includes a pair of diagonal sides and a section extending between the sides. The channel effectively divides the web and forms on each side of the channel an outer web surface that extends adjacent the channel the length of the stud. Each flange extends from the web and includes a side, back and a turned end that includes a terminal end and wherein the turned end extends generally parallel with the side of the flange.

18 Claims, 4 Drawing Sheets

(56) References Cited

U.S. PATENT DOCUMENTS

| | | | |
|---|---|---|---|
| 6,199,336 | B1 | 3/2001 | Poliquin |
| 2003/0163970 | A1 | 9/2003 | Moore et al. |

OTHER PUBLICATIONS

AISI S200-7, "North American Standard for Cold-Formed Steel Framing—General Provisions," American Iron and Steel Institute, pp. 4-5, 2007.
ASTM C 645-07, "Standard Specification for Nonstructural Steel Framing Members," Jan. 2007 (1 page).
ASTM C 955-06, "Standard Specification for Load-Bearing (Transverse and Axial) Steel Studs, Runners (Tracks), and Bracing or Bridging for Screw Application of Gypsum Panel Products and Metal Plaster Bases," Jun. 2006 (1 page).
Decision on Appeal corresponding to U.S. Appl. No. 10/690,038 dated Dec. 14, 2009.
Decision on Request for Rehearing corresponding to U.S. Appl. No. 10/690,038 dated Sep. 24, 2010.
Examiner's Answer corresponding to U.S. Appl. No. 10/690,038 dated Jul. 21, 2008.
Hexaport International Ltd., "Strong Stud," www.hexaport.com/stron.stud.htm, downloaded on Apr. 18, 2016 (1 page).
Office Action corresponding to U.S. Appl. No. 10/690,038, dated Mar. 23, 2006.
Office Action corresponding to U.S. Appl. No. 10/690,038, dated May 4, 2007.
Office Action corresponding to U.S. Appl. No. 10/690,038, dated Oct. 12, 2007.
Office Action corresponding to U.S. Appl. No. 10/690,038, dated Oct. 2, 2006.
"Definition of stud," downloaded from http://education.yahoo.com/reference/dictionary/entry/stud;_ylt=Ag5QvexxZR7_ZBUCiCv, pp. 1-2, downloaded Mar. 2, 2007.
Wikipedia, Walls at https://en.wikipedia.org/wiki/Wall#Partition_wall.
Gibson, Scott; "How to Frame a Partition Wall," This Old House Magazine, available at http://www.thisoldhouse.com/toh/how-to/intro/0,,217320,00.html.

* cited by examiner

LOAD BEARING METAL STUD

CROSS REFERENCE TO RELATED APPLICATION

This is a continuation-in-part of U.S. patent application Ser. No. 10/690,038 filed Oct. 21, 2003. The disclosure of this patent application is incorporated herein by reference.

FIELD OF THE INVENTION

The present invention relates to metal studs and more particularly to load bearing metal studs.

BACKGROUND OF THE INVENTION

Light gauge metal studs have long been used in non-load bearing walls in commercial buildings. Generally these non-load bearing metal studs are of a basic C-shaped or channel construction. There are many advantages to using metal studs in wall structures. They form straight and true walls and allow for rapid construction. Generally speaking there are other advantages to using metal studs. These include durability, resistance to fire and termites and because metal studs are dimensionally stable they will not expand or contract with humidity changes.

In the past load bearing metal studs have been used but they have not been used to the extent of non-load bearing metal studs. However, there are also advantages to be gained from utilizing load bearing metal studs. Costs are generally lower than with other traditional methods of construction such as masonry, steel, precast and concrete. Load bearing metal studs can be efficiently erected even in poor weather conditions. Like the advantages in non-load bearing walls, metal studs in load bearing walls form straight and true wall structures and can be erected quickly.

Conventional channel shaped metal studs, such as those used in non-load bearing applications, are not as structurally efficient for load bearing applications where substantial bearing loads must be carried. Load bearing studs carry vertical floor and roof loads from above in addition to horizontal loads due to wind and other forces along the stud length. Non-load bearing studs carry horizontal loads due to wind and other forces along the stud length. Significant amounts of steel in conventional channel shaped studs are ineffective for load carrying purposes. For example, in a conventional channel shaped stud, the intermediate portion of the web carries less of the total axial load than comparable size outer sections of the web. Thus the strength to weight ratio of the stud is said to be relatively low.

Therefore, there is a need for a metal stud that is designed for high efficient axial load carrying capability and which consequently has a relatively high strength to weight ratio.

SUMMARY OF THE INVENTION

The present invention entails a load bearing metal stud that due to its design has a relatively high strength to weight ratio compared to conventional C-shaped metal studs. In one embodiment the metal stud comprises a web having an elongated channel having a pair of sides and a central section extending between sides. The elongated channel effectively divides the web and there is formed a pair of aligned sections or surfaces on opposite sides of the channel.

In a particular embodiment of the present invention there is provided an elongated metal stud that includes a web and a pair of flanges disposed on opposite sides of the web. Each flange includes a generally J-shaped structure. Formed in the web is an elongated channel depression that extends continuously from one end of the stud to the other end of the stud. The channel depression divides the web and forms a pair of outer surfaces or sections that extend in coplanar relationship alongside the channel depression over the length of the stud and wherein the outer surfaces or sections of the web are raised relative to the channel depression. Further, the channel depression includes a pair of angled sides and a central section and wherein the angled sides extend inwardly from the outer surfaces of the web to the central section of the channel depression.

In another embodiment of the present invention, a wall structure is provided. This wall structure includes a plurality of spaced apart studs that are connected between upper and lower support structures. Each stud includes a web and a pair of opposed flanges. The web of each metal stud includes a channel formed therein. The channel includes a pair of side sections and a section extending between the two side channels. Disposed on each side of the channel is an outer section. Thus the web includes two outer sections and an intermediate portion that is comprised of the side sections and the section extending between the two side sections.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, the load bearing metal stud is shown therein and indicated generally by the numeral 10. Metal stud 10 is of an open construction and basically comprises a web indicated generally by the numeral 12 and a pair of opposed flanges indicated generally by the numeral 14. By open construction it is meant that the metal stud 10 is not closed but includes an opening formed in the back of the stud.

Figure 1:
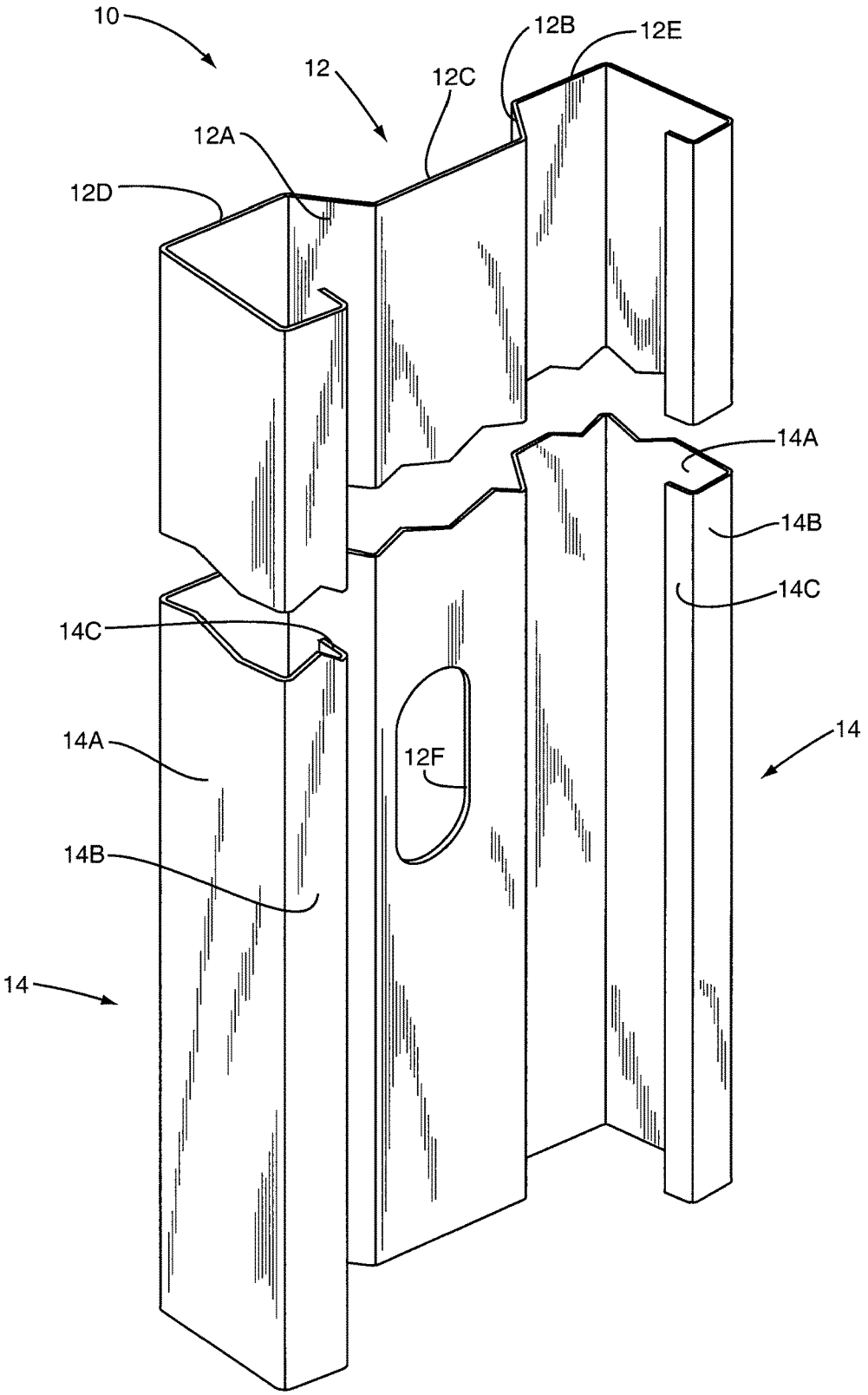
FIG. 1 is a perspective view of the load bearing metal stud of the present invention.
Figure 2:
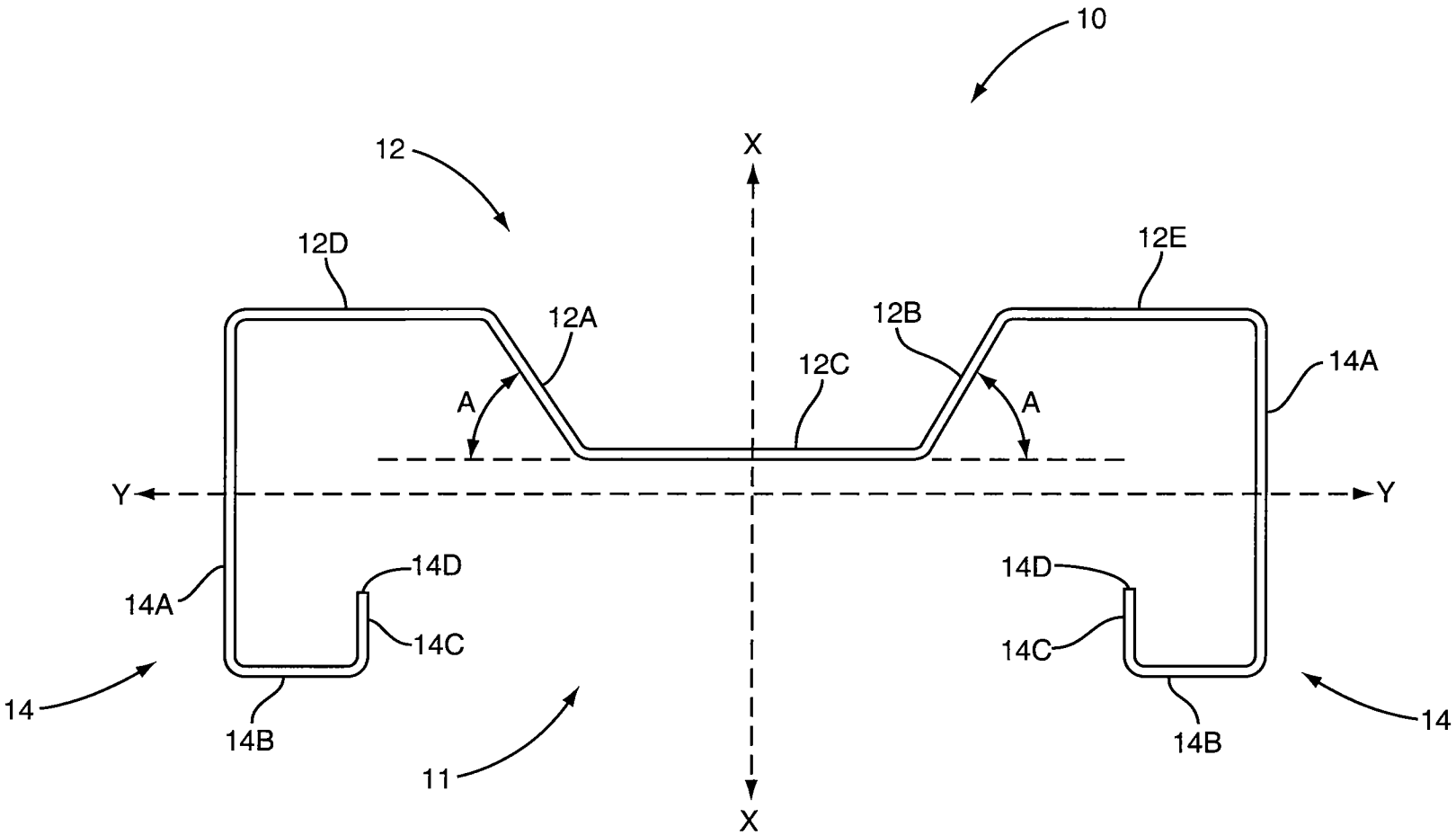
FIG. 2 is an end elevational view of the load bearing metal stud.

First, with respect to the flanges, each flange 14 is of a generally J-shape. It should be appreciated that the J-shaped configuration of the flange 14 forms a part of the particular embodiment disclosed herein but that the shape of the flange may vary. In any event, with reference to FIGS. 1, 2 and 3, flange 14 includes a side 14A. Side 14A extends from the front of the stud 10 to the back of the stud 10. Extending inwardly from the side 14A is a back or lip 14B. For purposes of reference, the backs 14B of the two flanges 14 form the back extremity of the metal stud 10. Extending from the back 14, towards the web 12, is a turned end 14C. Turned end 14C includes a terminal end 14D. Consequently, for this particular embodiment, it is seen in FIG. 2 that each flange 14 forms a generally J-shape. Further, the turned end 14C extends generally parallel with the side 14A of each flange 14.

Now turning to a discussion of the web 12, it is seen that the web extends between the two flanges 14 and for purposes of reference, the web 12 forms the front of the metal stud 10. A channel or channel depression is formed centrally in the web 12 and extends continuous from one end of the metal stud 10 to the other end of the metal stud. This central channel includes a pair of diagonal sides or side sections 12A and 12B. Extending between the diagonal sides 12A and 12B is a section 12C that happens to be a center section in this case. Because the channel is centrally located in the web 12, there is defined a pair of outer raised surfaces or sections 12D and 12E, as viewed in FIG. 2, on opposite sides of the channel. Surfaces 12D and 12E form a part of the web 12 and in this case are coplanar. Also, each surface or section 12D or 12E, is disposed at an angle generally normal to the side 14A of the adjacent flange 14. Finally, web 14 is provided with an opening 12F to accommodate stud spacers if desired.

As illustrated in FIG. 2 the diagonal sides 12A and 12B of the channel are disposed at an angle A with respect to a reference line that extends through the center section 12C of the channel. In this particular embodiment, angle A is approximately 37° and may vary between 15° and 89°.

From FIG. 2, it is seen that the channel or channel depression formed by sides 12A and 12B and the center section 12C are indented or recessed from the outer portions of the web 12 and are essentially set back into the area defined between the front and back of the stud 10. It is appreciated that the flanges 14 and particularly the sides 14A thereof tend to prevent the metal stud 10 from buckling in either direction of the reference line X. The web 12, on the other hand, and particularly the sections or surfaces thereof that extend parallel to the referenced line Y, tend to prevent the stud from buckling in either direction of the Y reference line. The sides 12A and 12B that form a part of the channel or channel depression in the web 12 also act to prevent buckling in either direction of the X reference line. This is because the diagonal sides 12A and 12B have a substantial structural component that extends parallel to the X reference line and therefore is effective to contribute to the resistance of buckling along the X reference line. Therefore, to some extent, the diagonal sides 12A and 12B are complimentary to the flanges 14 and particularly to the sides 14A of the flanges. Typically the thickness of the metal forming the stud would be in the range of 27 mils to 118 mils which equate to a gauge range of 22 to 10.

Likewise, in this case, the sides 12A and 12B have a structural component that is oriented parallel with respect to the Y reference line. Therefore, to some extent the sides 12A and 12B of the channel of the web tend to contribute to resisting buckling in either direction of the Y reference line.

Figure 3:
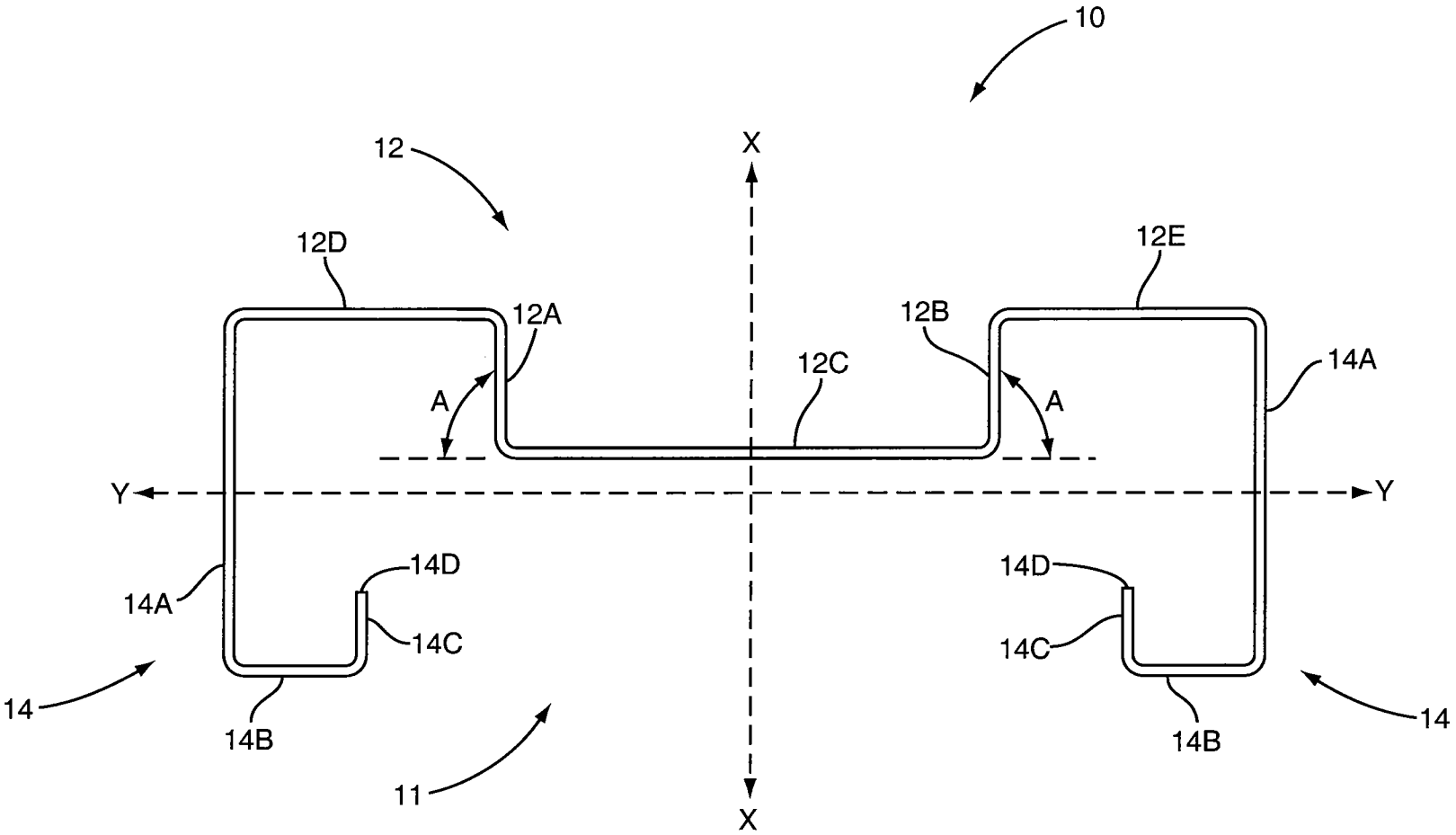
FIG. 3 is an end elevational view of an alternate design for the load bearing metal stud.

FIG. 3 illustrates an alternative design for the metal stud 10. In this case the sides or side sections 12A and 12B of the channel formed in the web are not diagonally disposed. As seen in FIG. 3, each side section 12A and 12B extends generally normal to the reference line extending outwardly from the section 12C. Thus angle A in the FIG. 3 embodiment is generally 90°. Note also that the side sections 12A and 12B extend generally normal with respect to the two outer sections 12D and 12E.

Figure 4:
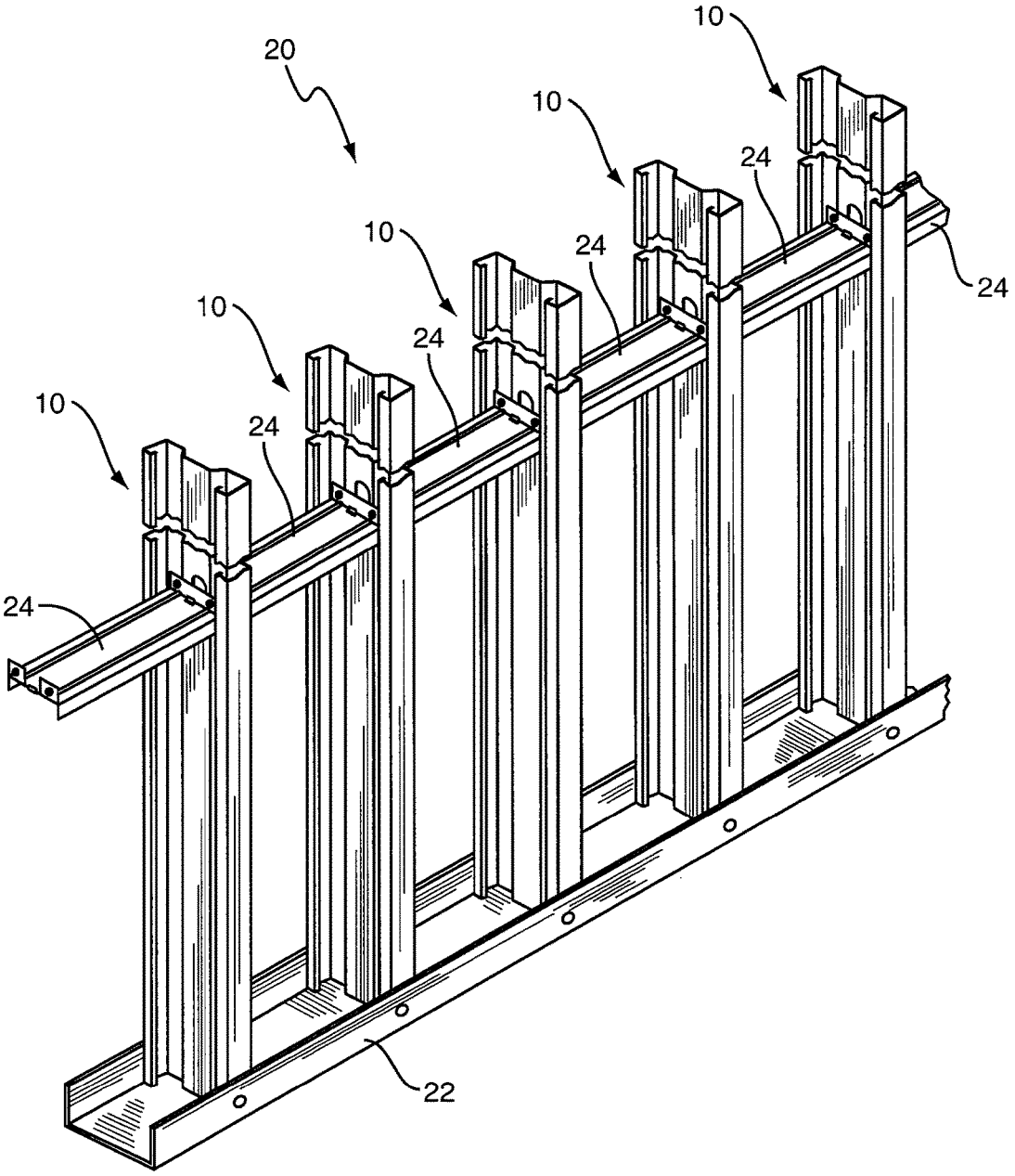
FIG. 4 is a fragmentary perspective view of a wall structure having the metal stud of the present invention incorporated therein.

Turning to FIG. 4, there is shown therein a wall section 20 that is particularly designed to be load bearing. In this wall section, there is provided a plurality of spaced apart metal studs 10 that are made according to the present invention. The respective studs 10 are secured between upper and lower support structures such as tracks. In this case, the respective studs 10 are connected to a lower track 22. Although not shown, the wall structure could include an upper track similar to the lower track. Also, in the embodiment illustrated in FIG. 4, there is provided a series of stud spacers 24 with the respective stud spacers extending between the respective studs 10. It is appreciated that the wall structure 20 disclosed herein would not require the stud spacers 24. They are optional.

Compared to a conventional C-shaped metal stud, the stud designs of FIGS. 2 and 3 are substantially more effective. Generally, the longer the individual elements or surfaces that make up the stud, the less efficient the elements become. That is, relatively long elements or surfaces of a metal stud become what is sometimes referred to as "thin" and do not proportionately contribute to the overall axial strength of the metal stud. For example, consider a standard 6-inch stud having 2-inch flanges and a ⅝" back or lip and a steel quality of 34 ksi. In such a design, the web extends straight across between the two flanges. A substantial portion of the web extending from the center outwardly towards the sides is ineffective. This, of course, means that the portions of the web adjacent the corners or flanges are more effective. As a general rule, the effectiveness of the stud design can be referred to as an effective width ratio. In the case of a conventional C-shaped metal stud, for purposes of reference and comparison, it is contemplated that the effective width ratio would be approximately 56%.

Turning to the metal stud shown in FIG. 2, note that the web of the stud is broken down into a series of sections or surfaces, 12A, 12B, 12C, 12D and 12E. Thus, the individual components or sections of the web have been shortened. As seen in FIG. 2, the respective sections are all disposed at an angle with respect to an adjacent section. This makes the entire web more effective. For a 6-inch stud having a steel quality of 33 ksi and a thickness of 33 mils, and conforming to the general design of FIG. 2, the effective width ratio is believed to be approximately 92%. By increasing the steel quality to 50 ksi and the thickness of the stud to 54 mils, the effective width ratio is believed to be increased to approximately 99.7%.

This can be compared to a 6-inch stud conforming to the basic design shown in FIG. 3 where the stud is of a 50 ksi quality and the thickness is 54 mils. The effective width ratio for this stud design is believed to be approximately 92%.

The particular overall dimensions of the metal stud 10 as well as its thickness may vary depending upon the loads to be carried, particularly the vertical loads. It is contemplated that in some applications, the thickness of the metal forming the stud would be in the range of 33 mils to 54 mils which would equate to a gauge range of 20 to 16. Further, it is contemplated that the angle of the diagonal sides 12A and 12B can be varied to address certain structural needs in certain applications. In any event, the metal stud 10 of the present invention is suitable for application in load bearing walls and because of the structural design of the stud itself, the stud is extremely efficient and has a relatively high strength to weight ratio.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. An axial load bearing metal stud comprising:

a. a web;

b. a pair of flanges disposed on opposite sides of the web;

c. an elongated channel depression formed in the web and extending continuously from one end of the load bearing stud to the other end;

d. the channel depression dividing the web and forming a pair of outer surfaces that extend alongside the channel depression over the length of the stud and wherein the outer surfaces of the web are raised relative to the channel depression:

e. wherein the channel depression includes a pair of diagonal sides and a central section and wherein the diagonal sides extend inwardly from the outer surfaces to the central section;

f. wherein the central section of the channel depression is substantially recessed into an interior area of the axial load bearing metal stud such that each diagonal side extends a depth into the interior area, the depth being selected such that each diagonal side is configured to provide a substantial contribution to a resistance of the axial load bearing metal stud to buckling in a direction generally perpendicular to the central section;

g. wherein each diagonal side forms a first obtuse angle with the central section and a second obtuse angle with one of the outer surfaces, and wherein the first and second obtuse angles are generally equal and each of the first and second obtuse angles is substantially greater than 90°; and h. wherein the load bearing metal stud is made of steel having a steel quality in a range of 33 ksi to 50 ksi and a thickness in a range of 33 mils to 54 mils sufficient for axial load bearing purposes, the steel quality, the thickness, and a shape of the web being configured such that the load bearing metal stud has an effective width ratio of between approximately 92% and approximately 99.7%.

2. The axial load bearing metal stud of claim 1, wherein the flange includes a J-shaped flange having a side, back and turned end.

3. The axial load bearing metal stud of claim 2, wherein a portion of the turned end extends generally in parallel relationship with the side of the flange.

4. The axial load bearing metal stud of claim 1, wherein the outer surfaces of the web are co-planar and wherein the central section of the channel depression extends in general parallel relationship with the outer surfaces of the web.

5. The axial load bearing metal stud of claim 1, wherein the stud has a steel quality of approximately 33 Ksi.

6. The axial load bearing metal stud of claim 1, wherein the metal stud includes a steel quality of approximately 50 Ksi and a thickness of approximately 54 mils and an effective width ratio of approximately 99%.

7. An axial load bearing metal stud comprising:

a. a web;

b. a pair of opposed flanges;

c. wherein the web comprises at least five different sections extending across the web including at least two outer sections, one center section and two intermediate sections with each intermediate section extending between one outer section and the center section;

d. wherein the center section is substantially indented with respect to the outer sections and wherein the outer sections are coplanar and the center section extends in general parallel relationship with the outer sections; and e. wherein each intermediate section forms a first obtuse angle with the center section and a second obtuse angle with one of the outer sections; and wherein the first and second obtuse angles are generally equal and each of the first and second obtuse angles is substantially greater than 90°;

f. wherein the center section is substantially recessed into an interior area of the axial loading bearing stud such that each intermediate section extends a depth into the interior area, the depth being selected such that each diagonal side is configured to provide a substantial contribution to a resistance of the axial load bearing metal stud to buckling in a direction generally perpendicular to the center section;

g. wherein the load bearing metal stud is made of steel having a steel quality in a range of 33 ksi to 50 ksi and a thickness in a range of 33 mils to 54 mils sufficient for load bearing purposes, the steel quality, the thickness, and a shape of the web being configured such that the load bearing metal stud has an effective width ratio of between approximately 92% and approximately 99.7%.

8. The axial load bearing metal stud of claim 7, wherein each flange is of a generally J-shape and includes a side, back and a turned end.

9. The axial load bearing metal stud of claim 8, wherein the sides of each J shaped flange is completely planar.

10. The axial load bearing metal stud of claim 7, wherein each intermediate section forms an acute angle of approximately 15° to 80° with respect to a reference line extending through the plane of the central section.

11. The axial load bearing metal stud of claim 7, wherein the central section of the channeled depression is completely planar and wherein the central section includes opposed sides that are smooth.

12. The axial load bearing metal stud of claim 7, wherein the web includes a front and a back and wherein the front is closed and formed by the web, and wherein the back is at least partially open so as to expose a portion of a back side of the web through a space that is defined by the opposed flanges, such that an interior area within the metal load bearing stud can be seen from a view through the spaced apart flanges.

13. An axial load bearing metal wall comprising:

a plurality of spaced apart C-shaped axial load bearing metal studs that form a portion of the axial load bearing metal wall each metal stud consisting essentially of:

a. a C-shaped single piece of metal that forms the entirety of the stud;

b. only one web;

c. only a pair of flanges disposed on opposite sides of the web, each flange including a generally J-shaped structure;

d. only one elongated channel depression formed in the web and extending continuously from one end of the stud to the other end;

e. the channel depression dividing the web and forming a pair of outer surfaces that extend alongside the channel depression over the length of the stud and wherein the outer surfaces of the web are raised relative to the channel depression;

f. wherein the channel depression includes a pair of diagonal sides and a central section, and wherein the diagonal sides extend inwardly from the outer surfaces to the central section;

g. wherein the central section of the channel depression is substantially recessed into an interior area of the axial load bearing metal stud such that each diagonal side extends a depth into the interior area, the depth being selected such that each diagonal side is configured to provide a substantial contribution to a resistance of the axial load bearing metal stud to buckling in a direction generally perpendicular to the central section;

h. wherein each diagonal side forms a first obtuse angle with the central section and a second obtuse angle with one of the outer surfaces, and wherein the first and second obtuse angles are generally equal and each of the first and second obtuse angles is substantially greater than 90°; and i. wherein the axial load bearing metal stud is made of steel having a steel quality in a range of 33 ksi to 50 ksi and a thickness in a range of 33 mils to 54 mils sufficient for load bearing purposes, the steel quality, the thickness, and a shape of the web being configured such that the load bearing metal stud has an effective width ratio of between approximately 92% and approximately 99.7%.

14. The axial load bearing metal wall of claim 13, wherein each J-shaped flange includes a side, a back and a turned end.

15. The axial load bearing metal wall of claim 14, wherein a portion of the turned end extends generally in parallel relationship with the side of the flange.

16. The axial load bearing metal wall of claim 13, wherein the outer surfaces of the web are co-planar and wherein the central section of the channel depression extends in general parallel relationship with the outer surfaces of the web.

17. The axial load bearing metal wall of claim 13, wherein the sides of the channel depression form an acute angle of approximately 37° to 80° with respect to a reference line extending through the plane of the central section.

18. The axial load bearing metal wall of claim 13, wherein each stud includes a closed front and an open back and wherein the front is formed by the web and wherein the web includes a front side and a back side and wherein both the front and back sides of the web are visible when the stud assumes a part of the load bearing metal wall.

* * * * *